United States Patent [19]

Braasch

[11] Patent Number: 4,965,966

[45] Date of Patent: Oct. 30, 1990

[54] GRINDING TOOL BODY

[76] Inventor: Gerd Braasch, Sassenberg 31, 4475 Sogel, Fed. Rep. of Germany

[21] Appl. No.: 283,530

[22] Filed: Dec. 12, 1988

[30] Foreign Application Priority Data

Dec. 11, 1987 [DE] Fed. Rep. of Germany ..... 3742038

[51] Int. Cl.[5] ..... B24B 55/06

[52] U.S. Cl. ..... 51/273; 51/356; 51/170 TL; 51/170 MT

[58] Field of Search ..... 51/170 TL, 170 MT, 273, 51/358, 362, 391, 392, 393, 175, 180, 204, 205 R

[56] References Cited

U.S. PATENT DOCUMENTS

| | | | |
|---|---|---|---|
| 1,291,572 | 1/1919 | Lorenz | 51/362 |
| 3,785,092 | 1/1974 | Hatchins | 51/170 MT |
| 4,274,232 | 6/1981 | Wylde | 51/358 |
| 4,437,269 | 3/1984 | Shaw | 51/394 X |
| 4,616,449 | 10/1986 | Marton | 51/273 |
| 4,680,895 | 7/1987 | Roestenberg | 51/273 X |
| 4,759,155 | 7/1988 | Shaw | 51/273 X |
| 4,779,385 | 10/1988 | Reiter | 51/273 X |

FOREIGN PATENT DOCUMENTS

| | | | |
|---|---|---|---|
| 225093 | 7/1985 | German Democratic Rep. | 51/362 |

*Primary Examiner*—Frederick R. Schmidt
*Assistant Examiner*—M. Rachuba
*Attorney, Agent, or Firm*—Collard, Roe & Galgano

[57] ABSTRACT

A grinding body for working surfaces, in particular wood surfaces, has a support part carrying grinding material. The support part is movable relative to the working surface and has suction ducts ending on a working side for vacuuming off the grinding dust by means of an external suction system. For improving the suction performance, the inlets of the suction ducts are arranged in first surface areas of the working side. These areas are recessed inwardly compared with grinding second surface areas of the working side. Thus, each first surface area has the inlet of the suction ducts at the bottom of a recess in the working side.

15 Claims, 6 Drawing Sheets

GRINDING TOOL BODY

BACKGROUND OF THE INVENTION

1. Field of the Invention

This invention relates to a body for a vibrating grinding tool for grinding working surfaces, in particular wood surfaces. The grinding tool body is comprised of a support part carrying grinding material, the support part being movable relative to the working surface and having suction ducts ending on a working side for vacuuming off the grinding dust by means of an external suction system.

2. Description of the Prior Art

In grinding operations, particularly in the timber-processing industry, grinding dust is collected in substantial quantities. According to recent findings, grinding dust, especially of beech and oak timber, may be hazardous to the health. For this reason, applicable legal regulations specify that grinding dust released into the air is not to exceed predetermined quantities, for example, 5 mg per cubic meter of air, within the area of a work station. Such values could be attained, until now, only with stationary grinding machines and tools, because such machines and tools can be constructed in a manner whereby they are completely encapsulated. However, a substantial portion of the grinding work performed is done by hand. This work is performed manually, either with manually guided grinding tools, in particular vibrating grinding tools, or by moving the workpiece to be ground relative to a grinding tool. In such manual grinding operations, in which the grinding tool and the workpiece move relative to each other, grinding dust is always produced at different points, i.e., where the workpiece is being ground at a given moment. As complete encapsulation with suction hoods is not possible in manual grinding operations, the release of grinding dust cannot be avoided. Consequently, a mixture of air and grinding dust spreads out around the work station and cannot be adequately entrapped, even with the most powerful suction systems.

It is well known to equip grinding tools used in manual grinding, in particular vibrating grinding devices, with bodies having a part supporting the grinding material. The latter is usually a grinding sheet, which is applied to the working side of the support part. The working side of the body is fitted with bores serving as suction ducts, and the grinding sheet has holes formed therein which, when the grinding sheet is applied to the working side of the body, are aligned with and cover the bores in the support part. The bores in the support part serve as suction ducts connectable with an external suction system. This suction system vacuums away the grinding dust produced during grinding via the holes in the grinding sheet and via the bores of the support part, and then discharges such dust.

It has been found that the suction performance during grinding with the prior art grinding tool bodies is nonexistent, or at least only minimal, because during grinding, the grinding sheet rests on the workpiece. This means that the workpiece practically covers the holes in the grinding sheet and consequently also covers the bores in the support part serving as the suction ducts. In grinding operations with these conventional grinding tool bodies equipped with vacuum grinding dust systems, no current of air that could carry along the grinding dust is produced.

SUMMARY OF THE INVENTION

The object of the present invention is to provide a grinding tool body designed in a way such that the grinding dust is effectively vacuumed away during the grinding operation.

It is yet another object of the invention to provide a grinding tool body which is simple in design, economical to manufacture, and which can be easily connected to an external vacuum system.

Accordingly, these and related objects are achieved by a grinding tool body having the suction openings or the inlets of the suction ducts arranged in first surface areas of the working side that are recessed deeper inwardly relative to the second grinding surface areas of the working side of the body.

Arranging the inlets of the suction ducts in the first surface areas that are deeper relative to the second grinding surface areas has the advantage that the workpieces to be ground are in contact with only the second grinding surface areas and, consequently, not in contact with the deeper first surface areas. For this reason, the inlets of the suction ducts always remain open during the grinding operation. Due to the suction effect, a flow of air can be produced, which, during the grinding operation, constantly transports the grinding dust produced on the second surface areas to the suction duct inlets which remain clear. The grinding tool body according to the invention assures an adequate suction capacity for vacuuming away the grinding dust produced in the grinding operation.

Each first surface area having the inlets for the suction ducts may be located at the bottom of a recess on the working side, whereby each bottom of such a recess may have one suction duct inlet, or a plurality of inlets. The recesses may have any desired dimension and shape. Also, several recesses may be interconected or overlapping each other. The recesses may be shaped like trenches or slots. In particular, the recess may surround a second grinding surface area in such a way that grinding dust produced during grinding must always be collected within the recess area. Consequently, the dust is always in the area of an inlet of at least one of the suction ducts before such grinding dust reaches the outer limits of the support part or grinding tool body.

Preferably, the support part is formed as a plate. While the plate used as the support part may be rectangular, it also may be round, in which case it may be used as a rotating grinding dish. The material for the support part is an elastic material, preferably polyamide, which may be used with different hardness values. Soft material has the advantage that curved surfaces can be ground without any problem, as the support part of grinding body can readily adapt itself to the curved surfaces of the workpiece. Furthermore, the grinding capacities can be influenced by different hardness values of the support part. In addition, polyamide is a low-weight material, so that a support part made from such material has an advantageous low weight.

Preferably, the grinding tool body is made so that an exposed surface of the support part has projecting blocks, whereby the recesses in the first surface areas with the suction duct inlets are formed by a space between two adjacent blocks. Such blocks may be molded to form one single part together with the support part. However, the blocks also may be attached to the surface of the support part. In particular, a method for detachably coupling the blocks on the support part may be utilized in order to be able to replace the blocks, if need be.

Each block may be in the form of an oblong or rectangular bridge, whereby bridge-like blocks extend up to outer edges of the support part. This has the special advantage that the space between two adjacent blocks extends up to the edge of the support part, as well. Due to the fact that the inlets of the suction ducts are arranged in the bottom of the space, thus in the base area of the adjacent blocks, it is also possible, during grinding, to suck in air from the edge of the support part. This air now produces a constant flow of air carrying along grinding dust into the suction openings.

Each bridge, preferably, has a width of from 10 to 40 millimeters. Because the exposed surface of the bridges form the second grinding surface areas, there will be an adequate area of contact between the surface of the grinding tool body and the surface of the workpiece to be ground. In addition, the width of the bridges results in the grinding dust produced during the relative motion between the grinding tool body and the workpiece can be collected at a relatively high rate in the first surface area and sucked away via the suction duct openings.

To make the suction channels from the inlet up to the external suction system as short as possible, the support part has bores or holes forming ducts extending parallel to the plane of the top and bottom surface of its plate. Thus, such ducts extend in the interior of the support part parallel to the side thereof having the blocks arranged thereon. Such blocks may extend crosswise relative to the extension of the ducts. Also, the blocks may extend parallel to or diagonally relative to the ducts.

In such an arrangement, the ducts, to which a vacuum produced by an external suction system is admitted, can be connected with the inlets of the suction ducts in a very simple way by making each suction duct in the form of a bore in the bottom of the space between two blocks. These bores lead to and intersect with an associated duct in the support part. One or several bores may be associated with each suction duct, because each such suction duct intersects the spaces between adjacent blocks several times. Therefore, within each area of intersection, a bore can be formed in the bottom of the space and extend up to the duct in order to produce the continuous flow path.

The suction capacity can be influenced in any desired way by arranging hole patterns of the bores correspondingly. Of course, the suction capacity also is dependent upon the number of suction ducts and their dimensioning. The ducts can be attached to a connection element serving to make the connection with the suction system. Such a connection element interconnects the ends of the suction ducts, so that the vacuum produced by a suction system is distributed via the connection element to all the suction ducts. According to the design of the grinding tool body of the present invention, the suction ducts end in an edge surface of the plate-shaped support part. Thus, the connection element can be a molded part adapted to be arranged in front of or adjacent to the edge surface of the plate. Thus, all of the suction ducts extend in the suction direction, thereby forming the shortest possible suction distances. The molded part is adapted to be arranged in front of the edge surface and interconnects the suction ducts which all end in the edge surface. This design has the advantage that the dimensions of the molded part can be kept particularly small.

It has been found particularly beneficial to use a piece of hose made from elastic material as the molded part. For example, the first end of a simple piece of hose made from soft rubber may be put over the rectangular edge surface of the plate-shaped support part. This permits the easy connection of the ducts to an external suction system by connecting a suction hose line coming from the suction system with a second end of the hose serving as the molded part. This can be accomplished by simply plugging in the suction hose line from the suction system to the second hose end. To facilitate this connection, a spreading element is inserted in the piece of hose connectable with the support part, i.e., in the second end of the piece of hose extending from the support part. The spreading element may be in the form of a bushing made, for example, from plastic material. It is particularly advantageous if an end area of the bushing facing the support part is conically inwardly tapered, so that suction hose lines extending from the suction system with different diameters can be connected. By simply plugging in the suction hose lines of the suction system, even those with lower nominal width, such suction hose lines are tightly connected in the conically tapered end zone of the bushing as soon as they are inserted in the latter. These lines are held in place by the suction effect during the operation of the suction system.

To prevent the piece of hose forming the molded part attachable to the front edge surface of the support part from coming into contact with the surface of a workpiece to be ground, the support part has at least one supporting element projecting into the piece of hose. This supporting element is arranged so that it extends into the piece of rubber hose forming the molded part within its inlet area at an upward angle relative to the plane of the plate of the support part. This upwardly deflects the piece of hose in the area adjacent to the edge surface of the support part. Thus, contact with the surface of the workpiece to be ground is avoided. The supporting element may be, by way of example, a spring-like support strip anchored on the support part, for example, a support made from metal in the form of a bar or rod extending upwardly from the edge surface of the support part into the piece of hose and up into the bushing. This support is inserted in the piece of hose forming the molded part. When the suction system is shut down, the supporting element also serves to hold the plugged suction hose line tight.

For carrying out the grinding operation, the exposed side of each block is coated with grinding material. Such grinding material may be grinding linen or grinding or abrasive paper, which materials are all well known. The grinding linen or grinding paper may be cut to size in such a way that it covers the free top side of a block covered therewith. One sheet of grinding material may be exchangeably secured on each block. Suitable fastening means may be, for example, hook-type, even hook and loop type connections. However, joining the grinding material to the blocks by glueing may be considered, particularly if the exposed sides thereof forming the grinding surface areas have contours thereon for grinding profiled shapes.

According to an additional embodiment of the grinding body, it has been found especially advantageous to provide additional suction bores, each leading to an associated opening on the exposed side of each block for holding sheet-like grinding material thereon by suction. Such material may be placed on the surface of the blocks after suction is produced. With such an embodiment, worn grinding material can be easily replaced during grinding, since such material is kept in place on the top sides of each block only by the force of suction. Grinding material is installed, or worn grinding material replaced, by simply placing it on or removing it from the exposed surface of the blocks. So as to avoid displacement of the grinding material by sliding on the top side of each block due to the shearing forces produced in the course of grinding, each block is provided with a roughened surface profile. Such a profile may be formed also by attaching or applying a rough coating. This roughening increases the frictional resistance between the working surface of the block and the inner side of the grinding material.

For raising the suction capacity, it is necessary to avoid attracting too much secondary air (air external to the grinding body). Of course, increasing the suction capacity of the connected suction system could allow for adequate grinding dust removal by suction, in spite of the secondary air flow, but this requires larger expenditures of energy. It is, therefore, possible to equip the edge of the support part, at least in the area of the spaces between the blocks, with apron elements covering the ends of each space. Such apron elements may be formed by rubber strips or rims of bristles. Preferably, each apron element is made in the form of a brush projecting from the edge of the support part. Such a brush may be manufactured, for example, from a strip of rubber by making provision for a great number of cuts along a lengthwise edge of the strip, forming individual rubber bristles. The other lengthwise edge, which is uncut and still coherent, then makes it possible to fasten such a brush on the edge of the support part in order to cover the spaces between two adjacent blocks.

The grinding body of the present invention is particularly suitable as a special equipment component, for example, for swing grinders. Also, if fitted with a handle, it can be used for manual grinding, in which case a conventional vacuum cleaner can be used as the suction system.

These and other objects and advantages of the present invention will become apparent from the following description of the accompanying drawings, which disclose several embodiments of the invention. It is to be understood that the drawings are to be used for purposes of illustration only, and not as a definition of the invention.

BRIEF DESCRIPTION OF THE DRAWINGS

Further advantages and details can be gleaned from the drawings wherein similar reference numerals denote similar elements throughout the several views.

DESCRIPTION OF THE PREFERRED EMBODIMENTS

Figure 1:
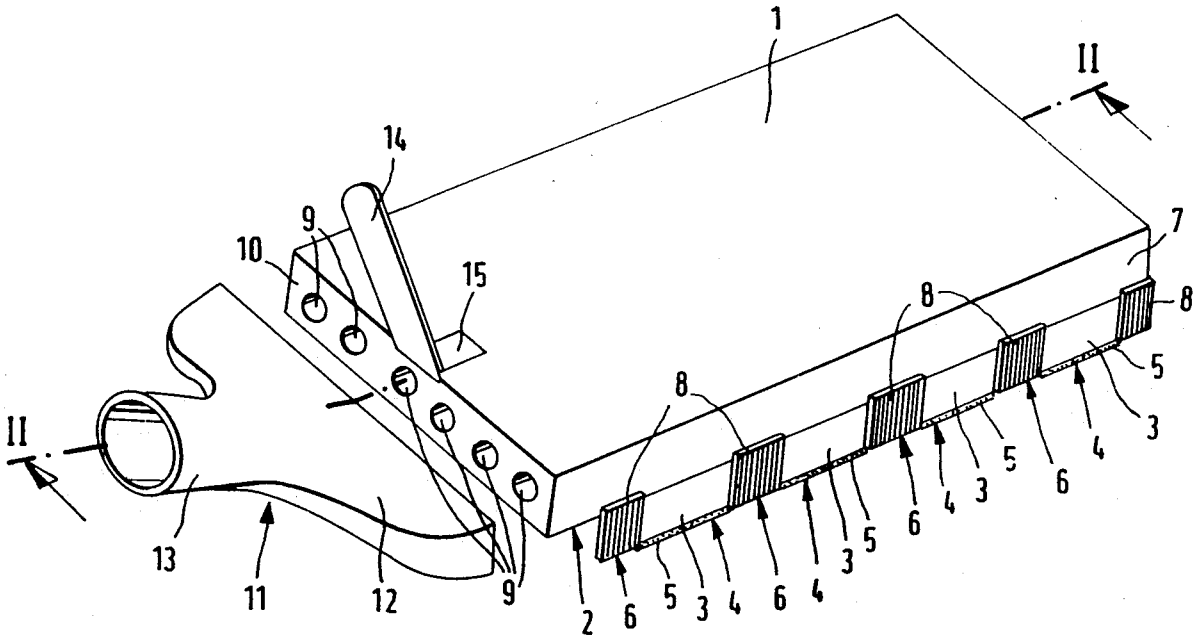
FIG. 1 is an isometric view of a grinding tool body with the connection element removed to show the openings of the bore-like suction ducts.

Referring to FIG. 1, there is shown a grinding tool body which may be used for manual grinding, but also in combination with a power grinding tool, for example, with a vibrating grinding tool. The grinding tool body is comprised of a plate-shaped support part 1 made from an elastic material, for example, a rubber-like material. The underside 2 of plate-shaped support part 1 is fitted with the projecting blocks 3. The latter may also be made from an elastic rubber-like material, and may be joined with plate-like support part 1 by glueing, vulcanizing or the like. However, it is also possible to shape the blocks on a slightly thicker plate made from such material, in which case support part 1 and blocks 3 are formed as one single piece. The free top sides form the grinding second surface areas 4 and are coated with the grinding material 5 in the form of a sheet. The spaces 6 between each adjacent block 3, are covered by apron elements 8 fastened on the outer edge 7 of support part 1. Apron elements 7 are described in greater detail hereinafter. Support part 1 has the bore-like suction ducts 9 extending parallel with the plane surfaces of the plate forming support part 1, each of such ducts end in an edge surface 10 of support part 1. A connection element 11, in the form of molded part 12, can be arranged on and sealingly attached to the front of edge surface 10. Connection element 11 serves for connecting the bore-like suction ducts with an external suction system (not shown). In the preferred embodiment, molded part 12 is a hose piece 13 made from rubber with one end capable of being stretched in such a way that it can be pulled over rectangular edge surface 10, thereby assuming the shape of the molded part 12, as shown. The end of a hose (not shown) can be plugged into the opening of hose piece 13, such hose being connected with a vacuum system in order to distribute the vacuum produced over suction ducts 9. A hose support 14 made from metal serves as the supporting element projecting into the hose piece. Support 14 is anchored to support part 1 at its foot 15 and bent in a way such that when engaging hose piece 13, it deflects the latter upwardly at an angle from the plane of the plate forming the top surface of support part 1.

Figure 2:
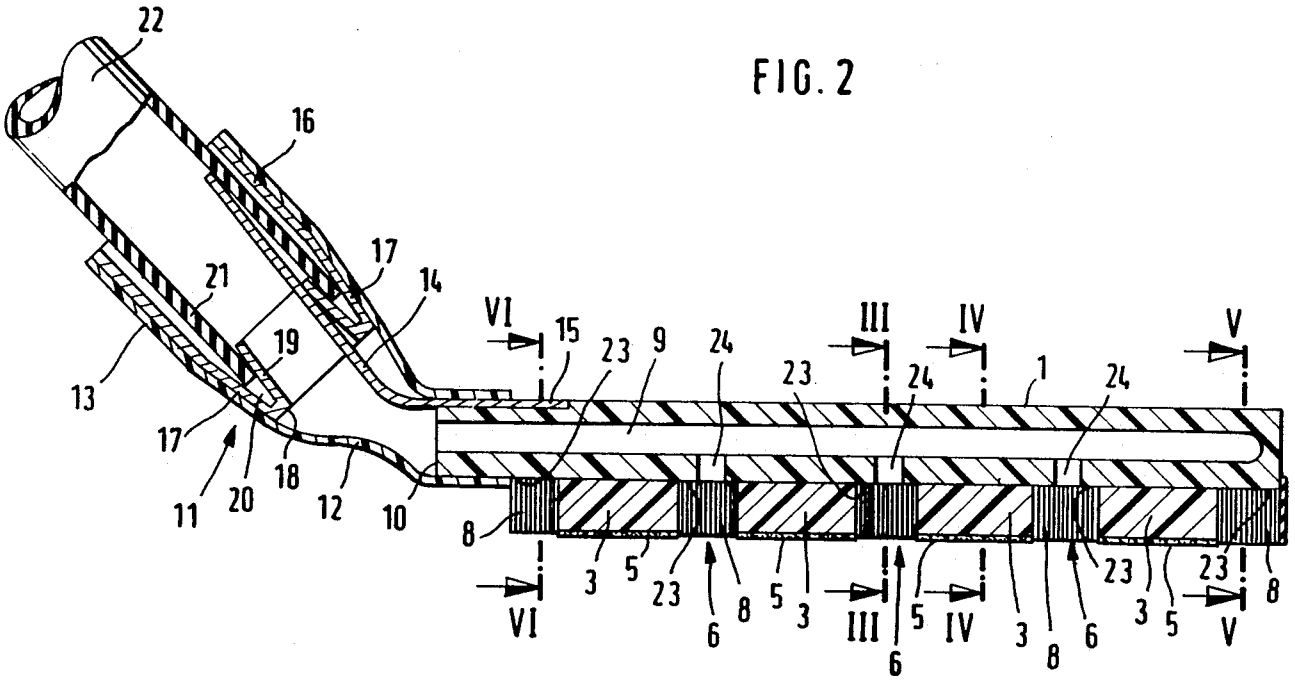
FIG. 2 is a cross-sectional view through the grinding tool body along line II—II on FIG. 1.

Referring to FIG. 2, there is shown a cross-sectional view along line II—II in FIG. 1. FIG. 2 shows how ducts 9 extend through support part 1, such ducts being arranged crosswise relative to the direction in which blocks 3 extend. Bore-like ducts 9 have openings communicating with hose piece 13 which may be stretched to form molded part 12 and surrounding the front of edge surface 10 of plate-shaped support part 1, whereby the hose piece serves as connection element 11. A spreading element is inserted into hose piece 13. In the present embodiment, the spreading element is in the form of bushing 16 which is conically tapered inwardly in an end zone 17 facing support part 1 and, at the bottom end 18, ends in an inwardly pointing inner bushing 19. In this way, an annuluar, conically tapered receiving space 20 is formed between tapered zone 17 and inner bushing 19, in which space the end of a hose extending from the suction system (not shown) can be clamped.

Suction ducts or bores 24 extend from the working surface through support part 1 to ducts 9. The recessed first surface areas 23, in which suction ducts 24 end, are disposed between individual blocks 3 on the bottom surface of support part 1. Each suction duct 24 is in the form of a bore or hole in the bottom of space 6 between two blocks 3 and in each case leads to the associated bore-like duct 9. During grinding, with the grinding material placed on the exposed sides of blocks 3, the grinding dust produced passes into space 6 between two blocks 3, in which a constant flow of air is also present. This air flow is produced by the continuously operating suction system. This air flow carries along the grinding dust within the immediate vicinity of the site where such dust is generated, and discharges such dust via ducts or bores 24 and suction ducts 9.

FIG. 2 shows how the connection element is set at an upward angle by support 14, so that it has no contact with the surface of a workpiece to be ground. Furthermore, FIG. 2 illustrates the special advantage offered by the flat design of plate-shaped support part 1. Support part 1 may be fitted, on its free upper surface, with a handle that permits combining the support part with a matching grinding tool, for example, with a manual vibrating grinder.

Figure 3:
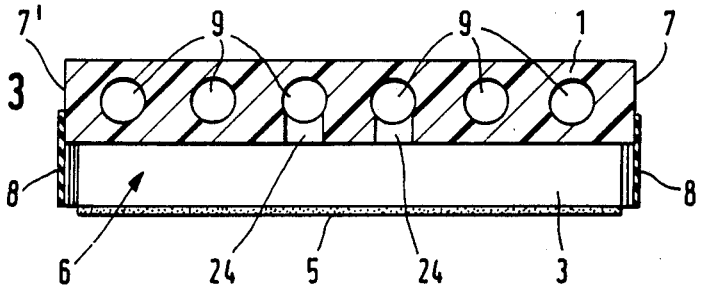
FIG. 3 is a cross-sectional view of the grinding tool body along line III—III on FIG. 2.

Referring to FIG. 3, there is shown a cross-sectional view through plate-shaped support part 1 along line III—III in FIG. 1. The block defining the space 6 is again denoted by reference numeral 3. The exposed side of the block representing the second grinding surface area is coated with grinding material 5. Plate-like support part 1 has six bores forming ducts 9 extending parallel with each other. The two center ducts are connected, via the suction ducts 24, with spaces 6, permitting such center ducts to suck in the grinding dust collected in spaces 6. Edges 7 and 7' are fitted with apron elements 8 covering the ends of spaces 6 on the outside.

Figure 4:
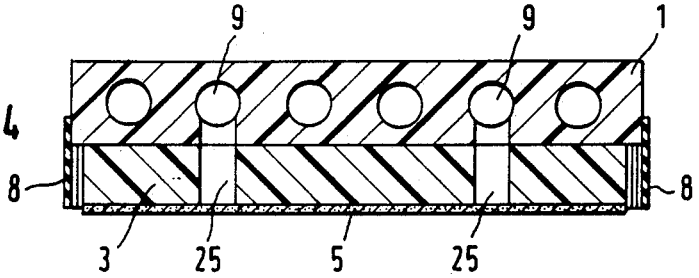
FIG. 4 is a cross-sectional view of the grinding tool body along line IV—IV on FIG. 2.

Referring to FIG. 4, there is shown a cross-sectional view through the support part according to FIG. 2 along line IV—IV. FIG. 4 shows that second bores 25 leading from the exposed side of block 3 to an associated duct 9 and may be provided. Second bores 25 have an opening in the exposed sides of block 3. Bores 25 may be used to hold sheet-like grinding material 5 in place by suction.

Figure 5:
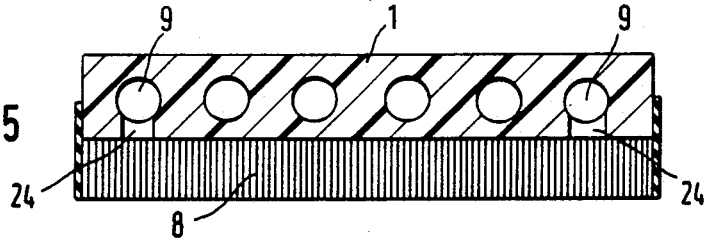
FIG. 5 is a cross-sectional view of the grindng tool body along line V—V on FIG. 2.
Figure 6:
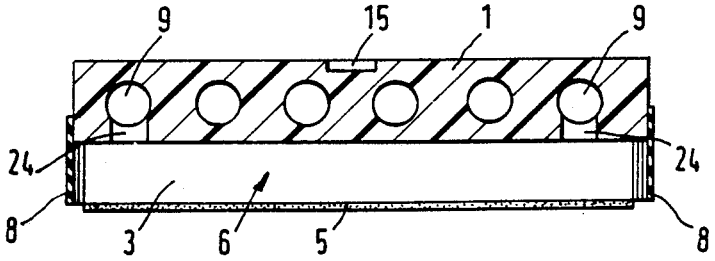
FIG. 6 is a cross-sectional view of the grinding tool body along line VI—VI on FIG. 2.

Referring to FIG. 5, there is shown that the inlets or open ends of the suction ducts 24 disposed in the end area of the support part are connected in each case with the outer ducts of bore-like ducts 9 in support part 1. Referring to FIG. 6, there is shown that suction ducts 24 are also connected with the outer bore-like ducts 9 in the front area of the support part 1. The foot of the support anchored in support part 1 is again denoted by reference numeral 15.

Figure 7:
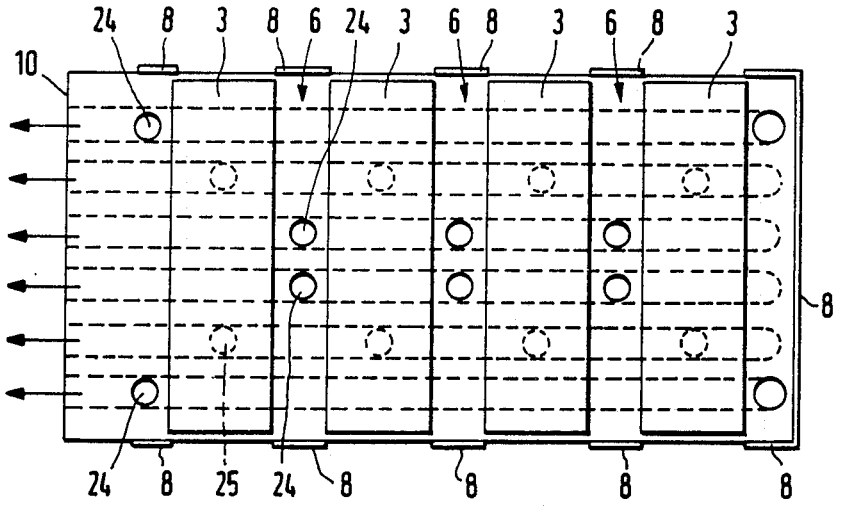
FIG. 7 is a view of the underside of the support part of the grinding tool body of FIG. 1 and FIG. 2, showing the working surface of the support part.

Referring to FIG. 7, there is shown the bottom of support part 1 corresponding with the cross-sectional views of FIGS. 3 to 6. Thus, the working side is shown to have a pattern of holes formed by the suction ducts. The extension of the ducts is indicated by the dashed lines. FIG. 7 also shows that all ducts 9 extend parallel with each other, whereby blocks 3 extend crosswise relative to ducts 9. The arrows on the left side indicate the direction in which the dust is sucked away, as suction ducts 9 end with their inlet openings in edge surface 10 of support part 1. Second bores 25, which serve the purpose of holding a grinding sheet placed on blocks 3 by suction, are also shown by dashed lines.

Figure 8:
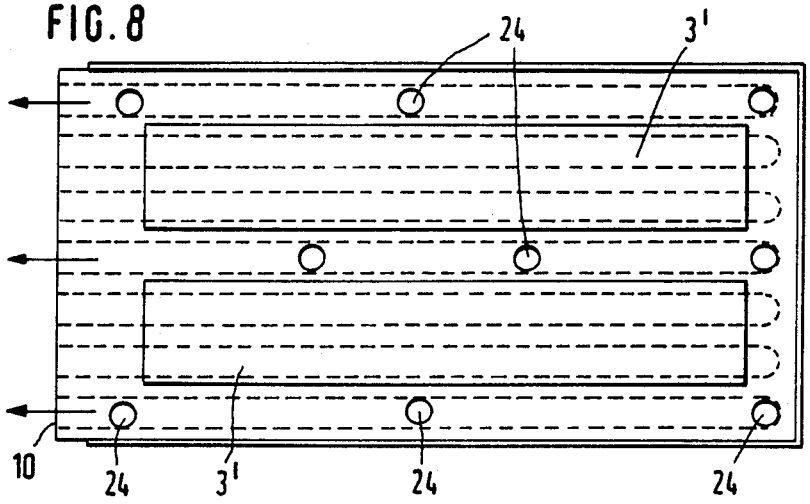
FIG. 8 shows the working surface of a support part according to a second embodiment of the invention.

Referring to FIG. 8, there is shown a bottom view of support part 1, with two blocks 3' extending parallel with the ducts 9, which end on edge surface 10 of support part 1. In the preferred embodiment, grinding material is secured on the exposed surface of the blocks, for example, by glueing, but may be connected with the blocks 3', as described above, also by means of suction. Again, the suction ducts 24 end with their inlet openings in the recessed surface areas disposed around the blocks 3' and serve to suck away the grinding dust.

Figure 9:
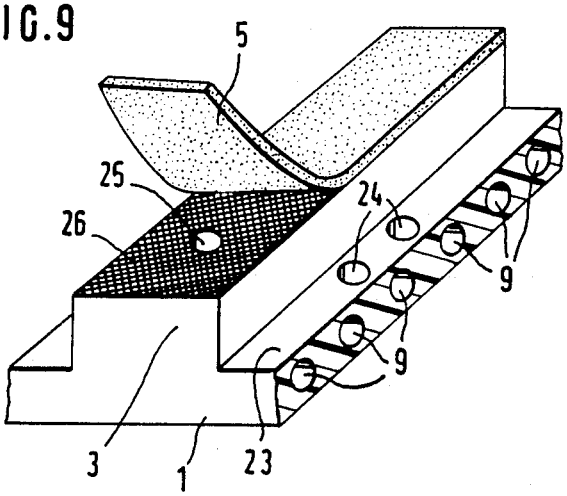
FIG. 9 is a partial isometric view of the embodiment corresponding to FIG. 4 showing the support part with a block and grinding material attached.

Referring to FIG. 9, there is shown a partial view of plate-like support part 1 on an enlarged scale. Again, the block placed on the support part 1 is denoted by reference numeral 3. Block 3 has, at its exposed side, a roughened profile 26, as shown in the figure. Such a profile serves the purpose of increasing the friction between the surface of block 3 and a sheet of grinding material 5 applied to the block. The sheet of grinding material may be removably held in place on the block 3 only by suction via the second bore 25. The suction ducts 24 within the immediate vicinity of the blocks in the recessed first surface area 23 serve to vacuum away the grinding dust.

Figure 10:
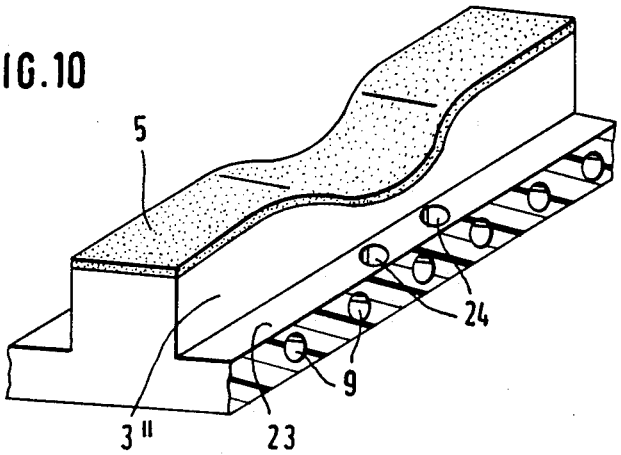
FIG. 10 is a partial isometric view of the support part with a profiled block.

Referring to FIG. 10, there is shown a partial isometric view of a support part within the area of a block 3', which, in the embodiment shown, has a contour formed in its free surface. This permits the grinding of corresponding shapes. In this embodiment, the sheet of grinding material 5 is fastened by glueing.

Figure 11:
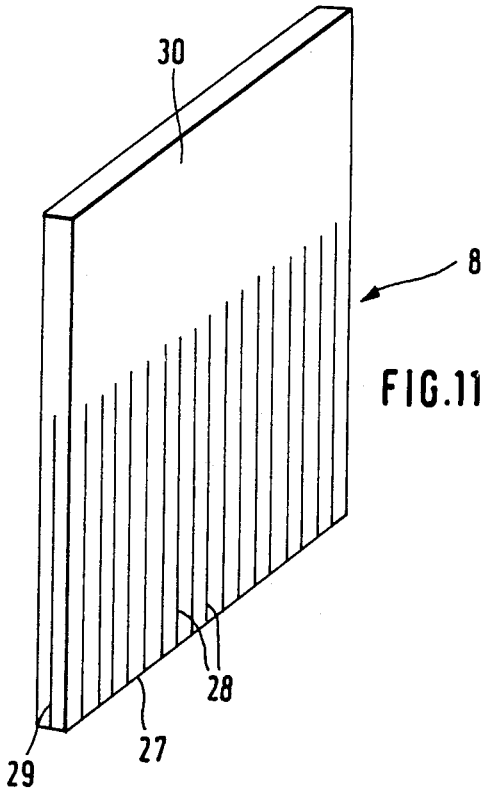
FIG. 11 is an enlarged view of an apron element.

Referring to FIG. 11, there is shown an enlarged view of an apron element 8. Each apron element consists of a rubber strip provided with several cuts 28 extending parallel with each other from a bottom edge 27. Also, provision may be made for a center cut 29 for dividing the material thickness in half. With the top uncut to form a continuous coherent edge zone 30, the rubber apron element, can be glued to edge surface 7 of plate-like support part 1.

Figure 12:
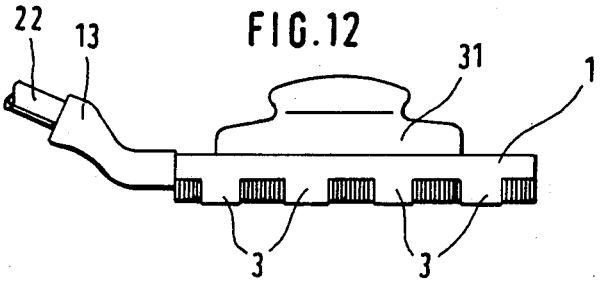
FIG. 12 is a reduced side view of the grinding tool body according to FIG. 11, with a handle fitted on the support part.

Referring to FIG. 12, there is shown a grinding tool body, as described above, in a reduced side view, whereby a handle 31 is fitted on to plate-shaped support part 1 opposite the working side thereof, with blocks 3. By using the handle, the grinding body can be guided by hand across a workpiece to be ground and the grinding dust produced during such grinding can be sucked away via hose piece 13 and vacuum hose 22 plugged into the hose piece.

While only several embodiments and examples of the present invention have been illustrated and described, it is obvious that many changes and modifications may be made thereunto, without departing from the spirit and scope of the invention.

What is claimed is:

1. A grinding tool body for grinding surfaces, in particular, wood surfaces, connectable to a suction system, the grinding tool body having a working surface thereon, the grinding body comprising:

a support part moveable with respect to the surface to be ground having a first surface and an outer edge;

a plurality of suction ducts extending through said support part and ending in an inlet opening on said first surface of said support part, said first surface recessed within said support part with respect to a second surface with grinding material thereon, said second surface forming the working surface of the grinding body; and a plurality of spaced apart blocks attached to said first surface, said blocks each having an exposed top side thereof forming said second surface, and said exposed top side having rough grinding profile, and said blocks including bores extending between an associated suction duct and the exposed top side of each block, said bores holding sheet-like grinding material onto said second surface by suction.

2. The grinding tool body, as defined in claim 1, wherein said support part is in the form of a plate.

3. The grinding tool body, as defined in claim 2, wherein said support part is made of polyamide.

4. The grinding tool body, as defined in claim 1, wherein said spaced apart blocks form a recessed area on said first surface containing said opening.

5. The grinding tool body, as defined in claim 1, wherein each block has an elongated shape in the form of an oblong rectangle.

6. The grinding tool body, as defined in claim 5, wherein said blocks in the form of an oblong rectangle extend up to outer edges of the support part.

7. The grinding tool body, as defined in claim 5, wherein each of said blocks in the form of an oblong rectangle has a width of between 10 and 40 mm.

8. The grinding tool body, as defined in claim 5, wherein the suction ducts in the support part extend in a direction parallel to each other and extend parallel to a plane defined by said first surface.

9. The grinding tool body, as defined in claim 8, wherein said blocks in the form of an oblong rectangle extend in a direction perpendicular to the direction of the suction ducts.

10. The grinding body, as defined in claim 8, wherein the blocks in the form of an oblong rectangle extend in a direction parallel to the direction of the suction ducts.

11. The grinding body, as defined in claim 2, wherein each suction duct includes a bore through said first surface in said space between said blocks forming said recess, said bore forming said opening and leading to an associated suction duct.

12. The grinding tool body, as defined in claim 1, wherein the suction ducts extend through a side surface of said support part and are connectable with a connection element serving to connect the suction system to the support part.

13. The grinding tool body, as defined in claim 12, wherein said connection element is in the form of a molded part arranged adjacent to and surrounding said side surface.

14. The grinding tool body, as defined in claim 1, wherein said sheet of grinding material is removably supported on each block.

15. The grinding tool body, as defined in claim 1, wherein each bore ending in the area of the exposed top side of each block and is located near an outer end of the block on its associated outer edge of the support part.

* * * * *